United States Patent [19]

Bosley

[11] Patent Number: 5,076,883

[45] Date of Patent: Dec. 31, 1991

[54] HIGHLIGHTER TYPE TAPE DISPENSER UNIT

[76] Inventor: Stephen C. Bosley, 30706 Tamarack, Wixom, Mich. 48096

[21] Appl. No.: 491,046

[22] Filed: Mar. 9, 1990

[51] Int. Cl.[5] ..... B32B 31/18

[52] U.S. Cl. ..... 156/522; 156/523; 156/540; 156/574; 156/577; 156/579

[58] Field of Search ..... 156/540, 541, 542, 574, 156/577, 579, 522, 523

[56] References Cited

U.S. PATENT DOCUMENTS

| | | | |
|---|---|---|---|
| 2,763,393 | 9/1956 | Gill et al. | 156/577 |
| 2,846,106 | 8/1958 | Castiglione | 156/523 |
| 2,868,402 | 1/1959 | Perry | 156/523 |
| 3,051,353 | 8/1962 | Krueger | 156/579 |
| 3,098,782 | 7/1963 | Powers | 156/577 |
| 3,211,604 | 10/1965 | Rymer | 156/577 |
| 3,829,346 | 8/1974 | Sullivan | 156/577 |
| 4,240,854 | 12/1980 | Massey et al. | 156/541 |
| 4,511,427 | 4/1985 | Karliner et al. | 156/577 |

*Primary Examiner*—Caleb Weston

*Attorney, Agent, or Firm*—Reising, Ethington, Barnard, Perry & Milton

[57] ABSTRACT

A highlighter type tape dispenser unit including a tubular housing through which a transparent, colored, and releasably attachable tape may be drawn from a suitable supply device and removably applied to a surface, such as a printed page. A cutter is included to cut off the applied tape in selected lengths. Thus, there is no need to permanently mark-up the printed material.

3 Claims, 1 Drawing Sheet

HIGHLIGHTER TYPE TAPE DISPENSER UNIT

TECHNICAL FIELD

This invention relates generally to tape dispenser units and, more particularly, to tape dispenser units which dispense removably applied tape to selected portions of surfaces, such as printed lines of text materials, which are preferably identified without leaving permanent markings thereon.

BACKGROUND ART

Heretofore, students studying their respective courses, in order to facilitate the learning process, have regularly marked selected passages in their texts in various ways, such as by underlining or by highlighting the selected lines with colored marking pens. Such markings, of course, permanently mark up the text book, making it either impossible to be resold, or resold at a substantially reduced value. When a second student comes into possession of a previously marked-up book, such markings tend to constitute an interference since the second student may prefer to highlight or mark up passages of his or her own choice.

Also, when researching text books or other periodicals or materials borrowed from a library or from others, one cannot mark up such materials in any manner. This may handicap the reviewing or studying thereof.

While tape dispenser units of various types are well known, none currently available are known to dispense a transparent, colored tape which may be releasably attached to selected lines of a printed page, eliminating the need to permanently mark up such printed page.

DISCLOSURE OF THE INVENTION

Accordingly, a general object of the invention is to provide an improved tape dispenser unit with which one may removably apply transparent, colored tape to printed pages.

Another object of the invention is to provide a tape dispenser unit which includes a tubular housing, a supply of transparent, colored, releasably attachable tape which may be drawn through the housing, suitable guide means for directing and pressing the tape against the surface to be marked, and reciprocally moveable cutter means for cutting off selected lengths of the applied tape.

A further object of the invention is to provide such a tape dispenser unit wherein the supply means may be either a spool-type wheel on which is wound a roll of the tape, or a box-like enclosure housing an accordion-like stack of the tape.

These and other objects and advantages will be more apparent when reference is made to the following drawings and the accompanying description.

BEST MODE OF CARRYING OUT THE INVENTION

Figure 1:
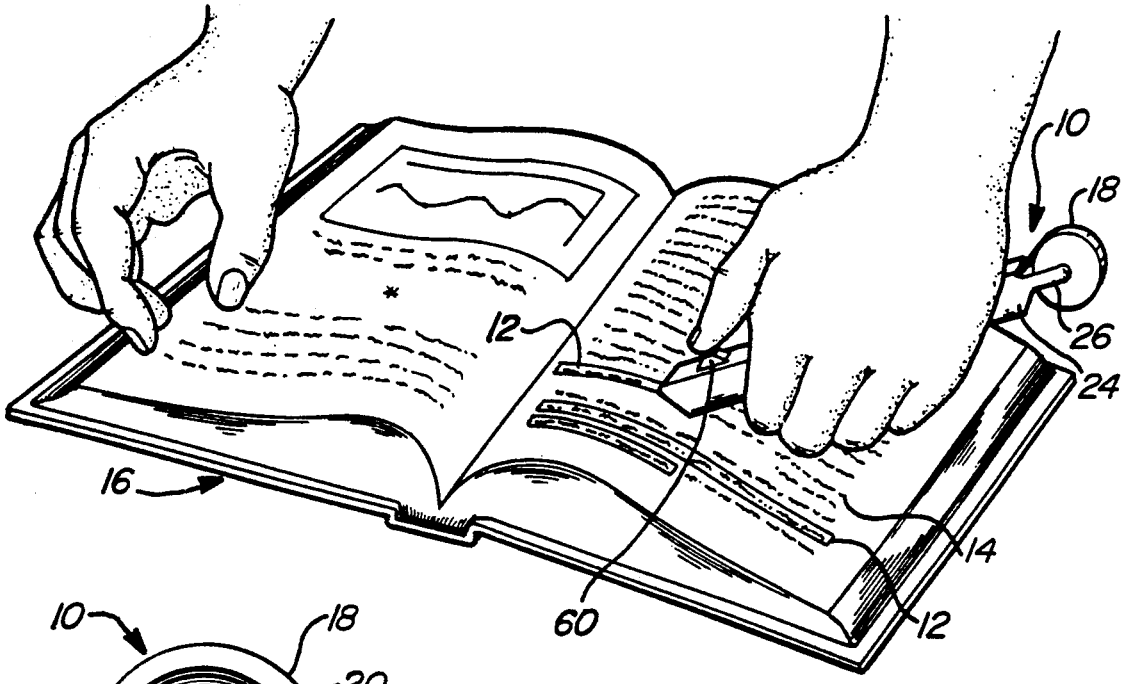
FIG. 1 is a perspective view of the inventive tape dispenser unit in an operational environment.

Referring now to the drawings in greater detail, FIG. 1 illustrates a highlighter type tape dispenser unit 10 being used to manually apply lengths of tape 12 to selected lines of text 14 in a text book 16. The tape 12 is transparent, may be any selected color, may be written on, and is of a type which is peelably removable after being applied to any surface.

Figure 2:
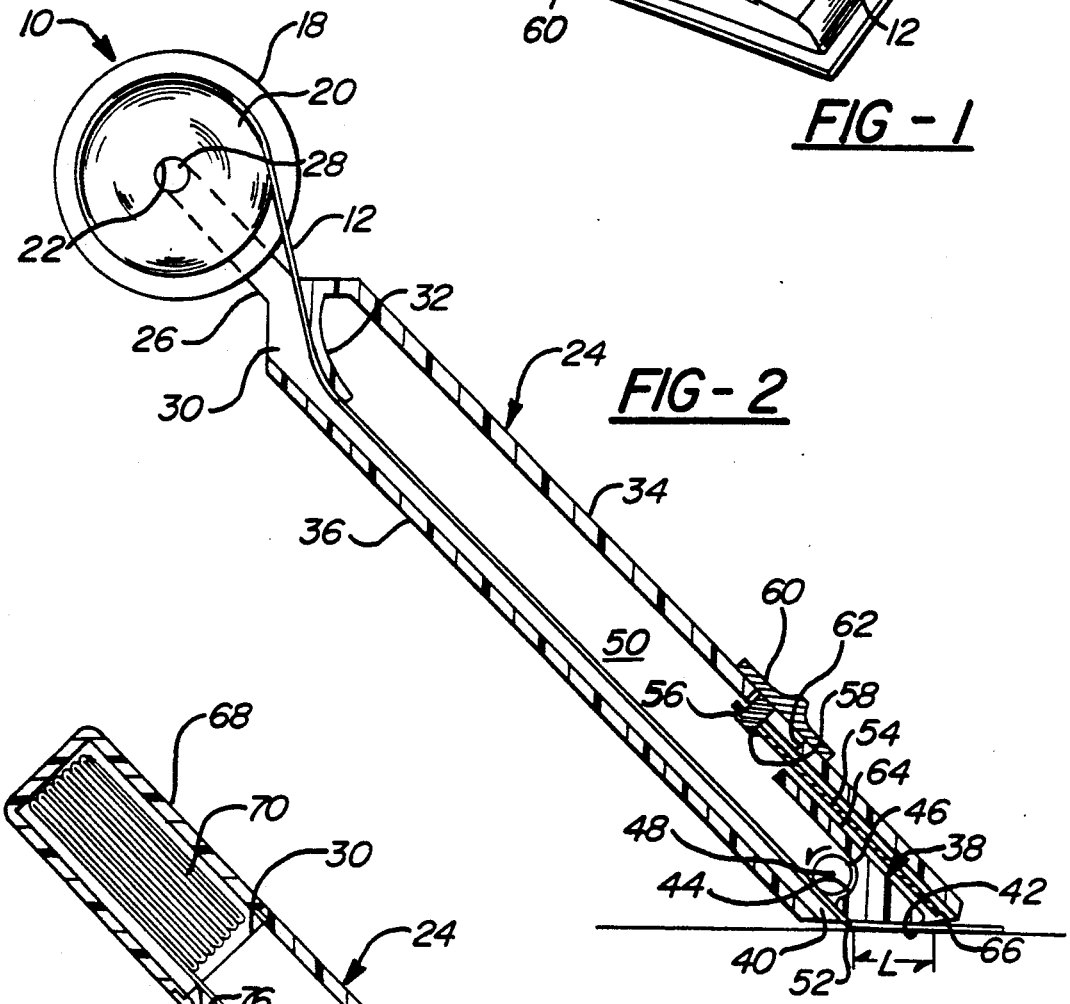
FIG. 2 is an enlarged cross-sectional view of the inventive tape dispenser unit.

As shown in FIG. 2, the dispenser unit 10 includes a spool type wheel 18 on which is wound a roll 20 of the tape 12. A central axial opening 22 is formed through the wheel 18.

A four-sided, tubular housing 24 is preferably formed of a suitable plastic material. A pair of spaced apart, parallel arms 26 are formed on one end of the housing 24, extending so as to straddle the oppositely disposed sides of the wheel 18. A cross member 28 extends between the distal ends of the parallel arms 26, through the opening 22 in the wheel 18, such that the latter is freely rotatable on the cross member 28.

The tape 12 extends into the open end 30 of the tubular housing 24, intermediate the spaced apart arms 26. A first guide member 32 is formed just inside the open end 30 to extend from the upper wall 34, as viewed in FIG. 2, of the housing 24 to direct the tape in a predetermined spaced relationship with the bottom wall 36.

A second guide member 38 is formed just inside the other open end 40 of the housing 24, and shaped to include a sloped exterior end surface 42 and an arcuate-shaped intermediate surface 44. A small roller 46 may be rotatably mounted adjacent the arcuate surface on a pin 48 extending between the side walls, represented at 50, of the housing 24. As may be noted in FIG. 2, the lower side surface 52 of the second guide member 38, assisted by the roller 46, serve to retain the tape in above-referenced predetermined space relationship with the bottom wall 36.

The open end 40 of the housing 24 is tapered so as to substantially be co-planar with the sloped exterior end surface 42 of the second guide member 38, permitting the dispenser unit 10 to be manually drawn across an underlying surface at a predetermined angle which is comfortable to the user. During such applying operation, the sloped exterior end surface 42 of the second guide member 38 serves to apply pressure to the tape which is being applied by the movement of the dispenser unit 10 across the selected surface.

A cutter blade 54 is secured at the inner end 56 thereof to a support arm 58 extending through an elongated opening 62 formed from an actuator member 60 in the upper wall 34. The actuator member is slidably mounted on the upper wall so as to cause the support arm 58 to be reciprocally movable in the elongated opening 62. As such, the blade 54 is caused to reciprocate intermediate the inner surface of the upper wall 34 and the upper surface 64, as viewed in FIG. 2, of the second guide member 38.

The outer sharpened end 66 of the blade 54 is thus able to be extended out of the open end 40 of the housing 24 in response to manual downward movement of the actuator member 60, to cut through the tape 12 once a desired length thereof has been laid across a line in a textbook, in the manner illustrated in FIG. 1. As may be noted in FIG. 2, once the tape 12 has been cut and the blade retracted, there would remain a short length of tape, represented as "L", extending across the end surface 42 of the second guide member 38, adapted to being attached to the next line which is to be highlighted.

Figure 3:
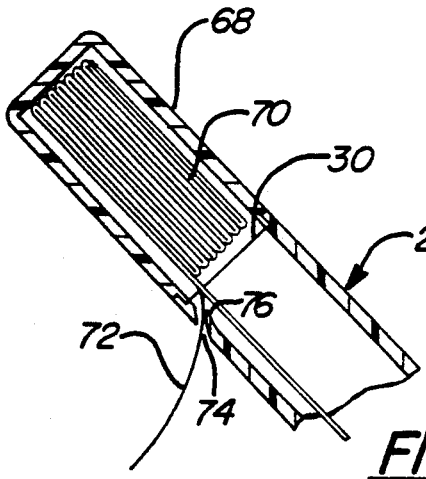
FIG. 3 is a fragmentary cross-sectional view of an alternate embodiment of the inventive tape dispenser unit.

Referring now to FIG. 3, as an alternate embodiment, in lieu of the spool type wheel 18, a box-like enclosure 68 may be detachably secured in any suitable manner to the open end 30 of the tubular housing 24. The enclosure 68 houses an accordion-like stack 70 of tape 12 having a backing layer 72 The latter layer is progressively removed through an opening 74 by a knife edge 76 formed just inside the open end 30, as the tape 12 is drawn through the housing 24 in the manner described above relative to the FIG. 2 structure.

INDUSTRIAL APPLICABILITY

It should be apparent that the invention provides a novel and efficient means for effectively highlighting important portions of textbooks or other documents, without causing any damage to the books or documents.

It should be further apparent that, in the event a line is mistakenly marked in the act of highlighting, it may be quickly and cleanly remedied without any permanent marking in the book or document being reviewed.

While but two embodiments of the invention have been shown and described, other modifications thereof are possible within the scope of the following claims.

The embodiments of the invention in which an exclusive property or privilege is claimed are defined as follows.

I claim:

1. For use with surfaces on which selected portions thereof are identified, a highlighter type tape dispenser unit comprising a tubular housing of a rectangular cross-sectional shape having upper, lower and two side walls, supply means for providing a strip of transparent releasably attachable tape into one end of the housing for egress from the other end thereof to be releasably attached to said selected portion, and cutter means for cutting off selected lengths of said attached tape;

said other end of said tubular housing tapered from the upper to the lower walls at a predetermined angle with respect to horizontal;

first and second guide members formed just inside the respective one and other ends of said tubular housing to maintain the tape in a spaced relationship with the upper and lower walls of the housing; and the exterior end surface of said second guide member sloped so as to conform to said predetermined angle of said other end of said tubular housing for applying pressure to said tape as it is being applied to said selected portions.

2. The highlighter type tape dispenser unit described in claim 1, and a roller rotatably mounted between said two side walls interior of said sloped exterior end surface to assist the egress of said tape as it is being applied beneath said second guide member.

3. The highlighter type tape dispenser unit described in claim 1, wherein said cutter means is a blade mounted intermediate the inner surface of the upper wall of said tubular housing and the upper surface of said second guide member, and actuator means mounted on the outer surface of said upper wall and operatively connected to said blade for reciprocally moving said blade beyond the end of said other end of said tubular housing adjacent said sloped surface of said second guide member to cut off selected lengths of said applied tape.

* * * * *